US006585042B2

(12) United States Patent
Summers

(10) Patent No.: US 6,585,042 B2
(45) Date of Patent: Jul. 1, 2003

(54) CEMENTING PLUG LOCATION SYSTEM

(76) Inventor: Jerry L. Summers, 8806 Crestmont Dr., Manvel, TX (US) 77578

( * ) Notice: Subject to any disclaimer, the term of this patent is extended or adjusted under 35 U.S.C. 154(b) by 0 days.

(21) Appl. No.: 09/968,074

(22) Filed: Oct. 1, 2001

(65) Prior Publication Data

US 2003/0062155 A1 Apr. 3, 2003

(51) Int. Cl.[7] ..... E21B 43/00
(52) U.S. Cl. ..... 166/64; 166/177.4; 175/45
(58) Field of Search ..... 166/64, 65.1, 66, 166/75.11, 113, 177.4; 175/40, 41, 45

(56) References Cited

U.S. PATENT DOCUMENTS 4,040,001 A * 8/1977 Vivet et al.
4,382,290 A * 5/1983 Havira
4,831,331 A * 5/1989 De et al.
5,763,773 A * 6/1998 Birchak et al.
6,189,383 B1 * 2/2001 Tello et al.

* cited by examiner

*Primary Examiner*—Roger Schoeppel
(74) *Attorney, Agent, or Firm*—Alan S. Atkinson

(57) ABSTRACT

An apparatus for locating cement plugs and other devices downhole in a wellbore. A cement plug is moved downhole into a wellbore through a casing, and a transmitter sends a signal to a receiver. A processor engaged with the receiver identifies the elevation or location of the cement plug. Accurate placement of the cement plug eliminates problems associated with underplacement and overplacement of cement in a wellbore.

18 Claims, 1 Drawing Sheet

CEMENTING PLUG LOCATION SYSTEM

BACKGROUND OF THE INVENTION

The invention relates to the field of cementing plugs downhole in wellbores. More particularly, the invention relates to an improved cementing plug system for identifying the location of one or more cementing plugs downhole in a wellbore.

Cement plugs and wipers are placed in a wellbore to facilitate and control the positioning and cement, fluids and other materials downhole in the wellbore. In cementing operations, a bottom plug is positioned in wellbore casing and liquid cement is pumped into the casing to move the plug downhole. The bottom plug displaces mud used in drilling operations and wipes the interior surface of the casing string. When the bottom plug reaches floating equipment such as a float collar, the fluid pressure differential ruptures the bottom plug to permit movement of the cement through the bottom plug and into the annulus between the casing and the wellbore rock.

As the cement is pumped into the casing, a top cement plug is often released into the casing to follow the cement and to wipe cement from the casing interior wall. When the top plug reaches the float collar further progress is impeded so that a resulting pressure increase notifies the operator that the top cement plug has reached the selected destination.

Many variations of cement plugs have been developed. For example, U.S. Pat. No. 6,196,311 to Treece (2001) described an improved cementing plug which can be used as a lower or top plug. U.S. Pat. No. 6,237,686 to Ryll et al. disclosed an elastomeric cement plug. U.S. Pat. No. 6,244,350 to Gudmedstad et al. (2001) disclosed a cement plug having hollow upper and lower sections and ports for selectively placing cement in a wellbore. U.S. Pat. No. 6,263,968 to Freeman et al. disclosed a combination of top and bottom cement plugs for placing cement in a wellbore.

Nonrotating cement plugs are used when polycrystalline diamond compact drill bits remove the plug and excess cement from the casing interior. U.S. Pat. No. 4,858,687 to Watson et al. disclosed a nonrotating cement plug, and U.S. Pat. No. 5,165,474 to Buisine et al. (1992) disclosed a cementing plug having deformable fins for resisting rotation of the plug.

To cement a casing in a wellbore, volumetric calculations consider the borehole dimentions and depth of the float valve. If a displacement plug does not reach the seat when the calculated total displacement volume has been pumped, pumping operations are typically stopped so that overdisplacement of the cement does not occur. Overdisplacement of the cement moves all of the cement outside of the casing. Underdisplacement of the cement leaves cement within the casing, requiring expensive and time consuming drilling operations to remove the misplaced cement. U.S. Pat. No. 5,095,988 to Bode (1992) disclosed a ball injection apparatus for launching cement plugs into well casing. Upper and lower plug assemblies sequentially launched balls, bombs or darts into the cement to control cement placement. To verify the location of the balls or other devices in the cement, a magnetic sensor was placed downhole to detect small magnets implanted in the balls and to trip a light indicating passage of the ball or other device.

Various techniques have been proposed to control the amount of cement pumped into a wellbore. For example, U.S. Pat. No. 6,170,574 to Jones (2001) disclosed a pump bailer for transporting cement downhole into the wellbore and for releasing the cement at a selected position within the wellbore.

Other techniques use wireline logging tools to locate the position of a cement column within a casing. For example, U.S. Pat. No. 6,189,383 to Tello et al. (2001) described a wireline logging tool for measuring the density of fluids downhole in a casing.

Various techniques lock a tool into a selected position downhole in a casing. Mechanical locking techniques are well known as a technique to positioning a tool, and one form of mechanical location device is identified in U.S. Pat. No. 6,199,632 to Shy (2001). Another form of mechanical locking device was disclosed in U.S. Pat. No. 4,491,178 to Terrell et al. (1985), which disclosed a wireline controlled setting tool having an explosive mechanism for activating operation of the tool downhole in the wellbore.

Cementing operations are subject to many variables. Variances in internal pipe diameter can significantly affect the column height of cement within the pipe. Recognized displacement factors do not account for the volume within each tool joint, leading to additional discrepancies in cement placement. In pipe including collars, drift in the internal diameter and gaps between the pipe and couplings create additional variables in the pipe string interior volume. Obstructions in the pipe string interior can cause a cement plug from landing short of the correlative landing collar. Lost circulation, washouts, and obstructions can interfere with cement placement, thereby jeopardizing the accuracy of identifying desired cement placement within the wellbore.

SUMMARY OF THE INVENTION

The invention provides a system for identifying the location of a body in a wellbore extending downwardly from the surface through subsurface geologic formations. The system comprises a body moveable in the wellbore, a transmitter for sending a signal through the wellbore which identifies the location of the body within the wellbore, a receiver for collecting the signal, and a processor engaged with said receiver for processing said signal and for identifying the location of the body within the wellbore.

In another embodiment, the invention provides a system for identifying the location of a cement plug in a wellbore extending downwardly from the surface through subsurface geologic formations, and comprises a body moveable in the wellbore, a transmitter attached to the body for sending a signal through the wellbore which identifies the location of the body within the wellbore, a receiver for collecting the signal, and a processor engaged with the receiver for processing the signal and for identifying the location of the body within the wellbore.

DESCRIPTION OF THE PREFERRED EMBODIMENTS

The invention provides a unique system for precisely locating a device downhole in a wellbore. The system is particularly suited to the location of plugs and other devices used in downhole cementing operations.

Figure 1:
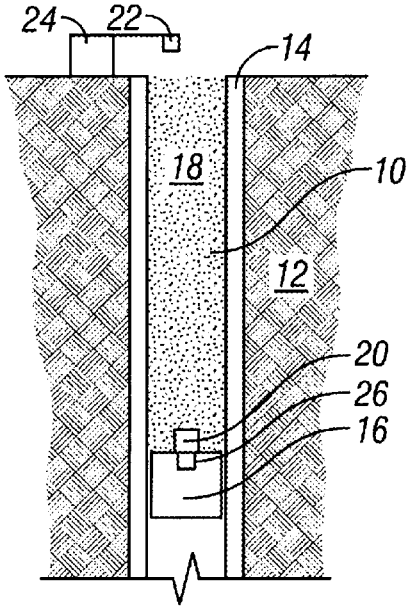
FIG. 1 illustrates a transmitter attached to a body downhole in a wellbore and a receiver located at the wellbore surface.

FIG. 1 illustrates one embodiment of the invention wherein wellbore 10 is formed through geologic formations 12 and casing pipe 14 is positioned within and becomes part of wellbore 10. Body 16 is movable within pipe 14 and can be surrounded on either side with well fluids such as cement 18. Body 16 can comprise an upper or lower cement plug, a valve, a whipstock, a packer, a chemical injection manifold, a pump, or other type of downhole drilling, workover or production equipment capable of use downhole in wellbore 10. Although, body 16 is moveable within wellbore 10 to permit access and installation therein, body 16 can be permanently or temporarily positioned at a selected location within wellbore 10 suitable for accomplishing a selected function.

Transmitter 20 is engaged with body 16 for sending a signal through wellbore 10. Receiver 22 collects the signal from transmitter 20, and processor 24 is engaged with receiver 22 for processing the signal and for identifying the location of body 16 within wellbore 10.

Transmitter 20 can be engaged with body 16 in different ways including proximity with, attachment to, or integration within body 16. As shown in FIG. 1, transmitter 20 is attached to body 16 in a preferred embodiment of the invention. In other embodiments of the invention, transmitter 20 can be integrated within body 16 to protect transmitter 20 from downhole temperatures, impacts, and corrosion. The location of transmitter 20 is preferably known relative to body 16 so that the signal generated by transmitter 20 indicates the location of body 16.

Figure 2:
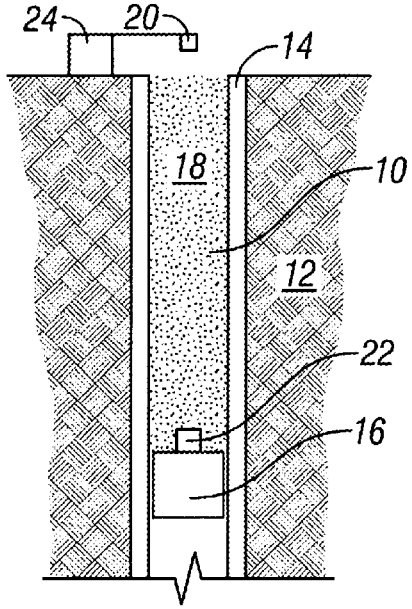
FIG. 2 illustrates a transmitter located at the wellbore surface and a receiver attached to the body.

Alternatively, transmitter 20 can be located at the wellbore surface as shown in FIG. 2, with receiver 22 engaged with body 16. Receiver 22 can communicate with processor 24 through different transmission techniques such as acoustic pulses detectable with pulse echo sensors, electrical signals transmitted through casing pipe 14, electrical signals transmitted through a wire (not shown) attached to casing pipe 14, through signals transmitted through geologic formations 12 (particularly useful in horizontal wells) and other transmission techniques known in the art.

Figure 3:
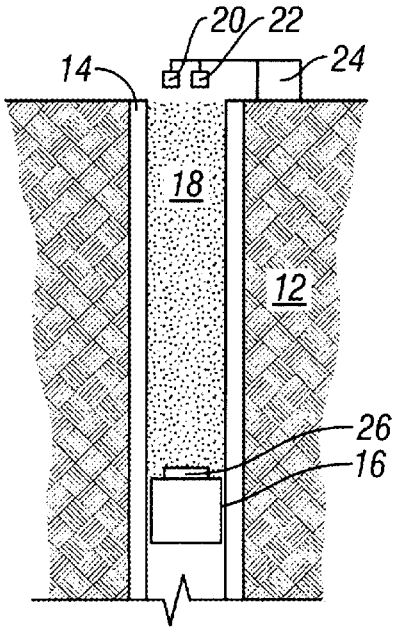
FIG. 3 illustrates a transmitter and transmitter located at the wellbore surface.

In yet another embodiment of the invention, transmitter 20 and receiver 22 can both be located at the surface of wellbore 10 as shown in FIG. 3, wherein the signal transmitted by transmitter 20 travels downwardly through wellbore 10, is reflected by body 16 and returns to the surface of wellbore 10 for detection by receiver 22. In this embodiment of the invention body 16 provides the function of a signal reflector, and the distance between transmitter 20 and body 16 can be calculated by the transmission time required for delivery and receipt of the transmitted signal. Signal reflector 26 can be attached to or integrated within body 16 to facilitate such function.

The location of transmitter 20 and receiver 22 will impact the physical character and requirements of such components. If transmitter 20 is to be moved within wellbore 10 as indicated in FIG. 1, battery pack 26 can be attached to transmitter 20 to provide sufficient power to generate the signals. Although electric wires can be attached between transmitter 20 and the receiver 22 to provide electrical power and signal transmission, one of the unique benefits provided by the invention is the capability to identify downhole location of body 16 without the encumbrances and disadvantages inherent with hard wires. This feature of the invention is particularly useful in deep wellbores 10 up to twenty thousand feet deep and in deviated and horizontal and multilateral wellbore branches extending thousands of feet in different directions from the surface entry of wellbore 10.

Figure 4:
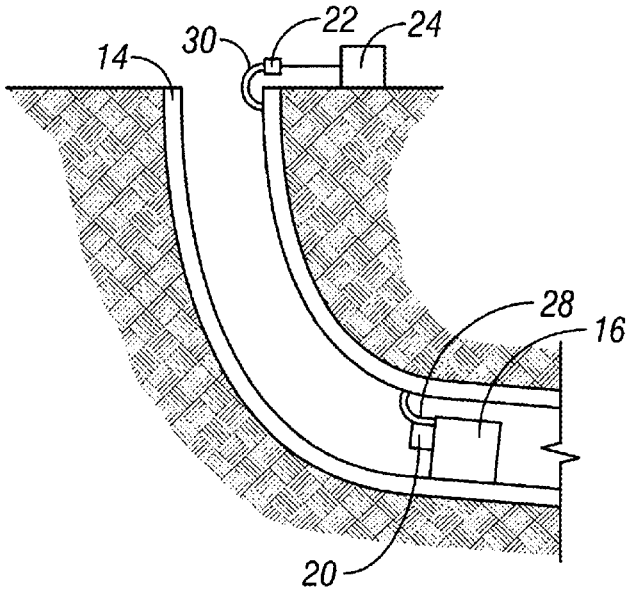
FIG. 4 illustrates a transmitter engaged with casing pipe for transmitting signals through the casing.

As previously indicated, signal transmission from a transmitter 20 located downhole in wellbore 10 can be made through fluids within wellbore 10, through geologic formations 12 overlaying wellbore 10, and through casing pipe 14. As shown in FIG. 4, transmitter 20 includes contact 28 for contacting the inner wall of casing pipe 14. Receiver 22 has contact 30 attached to casing pipe 14 Contact 28 permits signals to be transmitted from transmitter 20 to casing pipe 14 so that receiver 22 can detect such signals through contact 30.

Processor 24 receives the signals detected by receiver 22 and converts such signals into selected information. As representative examples, such information can indicate the distance between body 16 and the surface of wellbore 10, regardless of the offset of wellbore 10 from vertical, the elevation of body 16, the orientation of body 16, the heading of body 16, the proximity of body 16 to downhole features of wellbore 10 or of other devices within wellbore 10, the temperature or viscosity or pressure of fluids downhole in wellbore 10, and other data useful to the formation of or production from wellbore 10.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A system for identifying the location of a body movable through a wellbore extending downwardly from the surface through subsurface geologic formations, comprising;

a body moveable in the wellbore without the deployment of a wireline;

a transmitter for transmitting a signal through the wellbore which identifies the location of said body within the wellbore; and a receiver for collecting said signal; and a processor engaged with said receiver for processing said signal and for identifying the location of said body within the wellbore from the signal transmitted through the wellbore by said transmitter.

2. A system as recited in claim 1, wherein said transmitter is attached to said body.

3. A system as recited in claim 1, wherein the character of said signal sent by said transmitter can be changed.

4. A system as recited in claim 2, wherein said transmitter sends a signal correlating to a feature within the wellbore.

5. A system as recited in claim 4, further comprising a casing installed within the wellbore for directing movement of said body, and wherein said feature is positioned within said casing at a selected distance from the wellbore surface.

6. A system as recited in claim 1, wherein said transmitter is located at the wellbore surface and said receiver is attached to said body.

7. A system as recited in claim 1, wherein said body further comprises a signal reflector, wherein said transmitter and receiver are located at the wellbore surface and said signal is transmitted downwardly into the wellbore to be reflected by said signal reflector for transmission to said receiver at the wellbore surface.

8. A system as recited in claim 1, wherein said signal comprises an acoustic pulse.

9. A system as recited in claim 1, wherein said processor is capable of identifying the location of said body by determining the transmission time required for sending said signal between said transmitter and said receiver.

10. A system as recited in claim 1, wherein said processor is capable of identifying the elevation of said body within the wellbore.

11. A system as recited in claim 1, wherein said body comprises a cement plug.

12. A system as recited in claim 1, further comprising a casing installed in the wellbore for directing movement of the body and for conducting said signal between said transmitter and said receiver.

13. A system for identifying the location of a cement plug moveable through a wellbore extending downwardly from the surface through subsurface geologic formation, comprising:

a body moveable in the wellbore without the deployment of a wireline;

a transmitter attached to said body for transmitting a signal through the wellbore which identifies the location of said body within the wellbore; and a receiver for collecting said signal; and a processor engaged with said receiver for processing said signal and for identifying the location of said body within the wellbore from the signal transmitted through the wellbore by said transmitter.

14. A system as recited in claim 13, wherein said receiver is located at the wellbore surface.

15. A system as recited in claim 13, wherein said signal comprises an acoustic signal.

16. A system as recited in claim 13, further comprising at least two transmitters each attached to a body movable through the wellbore for transmitting different signals to said receiver.

17. A system as recited in claim 13, wherein said transmitter is capable of identifying a feature downhole in the wellbore and of identifying said feature in said transmitted signal.

18. A system as recited in claim 13, wherein said body and said transmitter are drillable to facilitate removal of said body and transmitter from the wellbore.

* * * * *